US005250003A

United States Patent [19]

Ferre

[11] Patent Number: 5,250,003

[45] Date of Patent: Oct. 5, 1993

[54] DOLL WITH INGESTION SYSTEM

[75] Inventor: Jose M. R. Ferre, Alicante, Spain

[73] Assignee: Creatividad Y Diseno S.A., Granada, Spain

[21] Appl. No.: 851,808

[22] Filed: Mar. 16, 1992

Related U.S. Application Data

[63] Continuation-in-part of Ser. No. 708,676, May 31, 1991, abandoned.

[30] Foreign Application Priority Data

May 7, 1991 [ES] Spain ..... 9101371

[51] Int. Cl.[5] ..... A63H 3/28; A63H 3/24

[52] U.S. Cl. ..... 446/301; 446/304

[58] Field of Search ..... 446/304, 305, 297, 301, 446/300, 298, 303

[56] References Cited

U.S. PATENT DOCUMENTS

| | | | |
|---|---|---|---|
| 3,406,482 | 10/1968 | Ryan et al. | 446/304 |
| 4,192,092 | 3/1980 | Goldfarb et al. | 446/304 |
| 5,037,345 | 8/1991 | Nakayama | 446/304 X |

*Primary Examiner*—Mickey Yu

*Attorney, Agent, or Firm*—Lackenbach Siegel Marzullo Aronson and Greenspan

[57] ABSTRACT

A cookie eating toy doll having a head, limbs and body, and a mouth with upper and lower lips, and a cookie "eating" mechanism. A storage area is also provided in the body for the cookies fed to the doll, and a passageway leads from the mouth to the storage area. A pair of cookie rollers advance a cookie into the doll's mouth when placed therein; and an electrically driven motor including a drive train rotates the cookie rollers enabling the cookie to be drawn into the mouth in and discharging the cookie into a passageway which directs the cookie to a storage area in the body of the doll.

20 Claims, 7 Drawing Sheets

DOLL WITH INGESTION SYSTEM

This patent application is a continuation-in-part patent application of my earlier filed copending U.S. patent application Ser. No. 708,676, filed May 31, 1991, now abandoned.

The present invention relates to a toy doll capable of digesting cookies.

SUMMARY OF THE INVENTION

More specifically, the doll is adapted to permit cookies of the slab type to be introduced through the mouth, which simulates eating, and having been eaten they fall by gravity to the bottom of an internal box, from which they can easily be extracted, and at the same time the doll reproduces at desired or predetermined intervals a series of sounds, in the manner of changing phrases, which it emits through an acoustic device connected to an electronic circuit.

The doll, which outwardly assumes the conventional form of a baby boy or girl contains in its interior an electromechanical assembly, including a set of wheels, situated in line with the mouth, and when the cookie type slabs are introduced, they cause their intermittent entrainment and subsequent fall into the internal box, from which they can be extracted through an opening with flap cover on the doll's back.

At the same time and coordinated with the entrainment of the cookies, one hears externally, through an acoustic device, sounds in the form of phrases which begin to be emitted when the electronic circuit that regulates their emission is connected and continue, with different phrases, during the penetration of the cookie, to return to the original phrase once the cookie has finally fallen into the box.

The description of this object will be illustrated with a set of drawings, showing a preferred example of execution, which is not limiting but merely explanatory, as it may be the subject of changes of detail in whatever does not affect its characteristic purpose.

DESCRIPTION OF THE PREFERRED EMBODIMENTS

Figure 1:
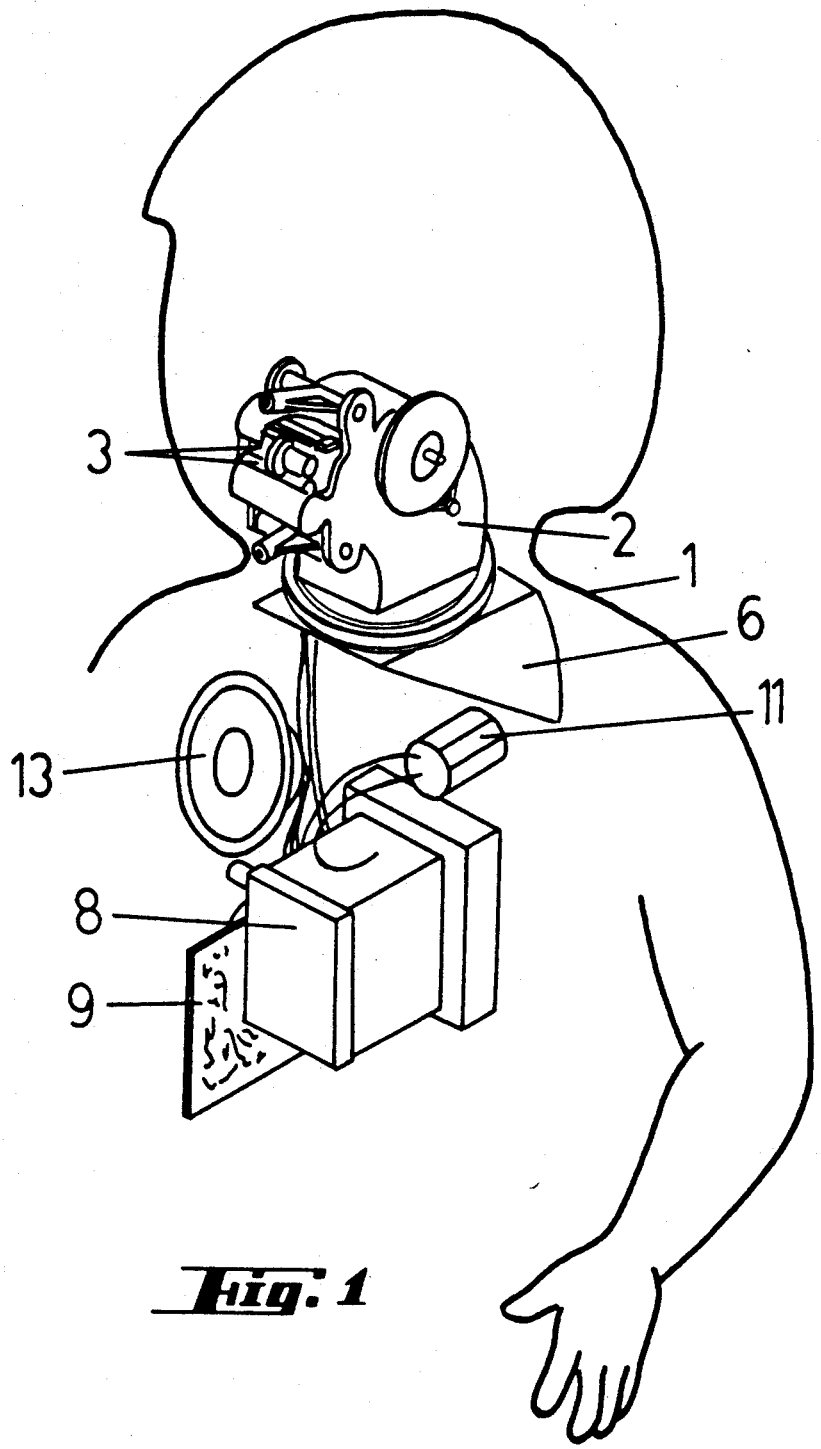
FIG. 1 is a perspective front view of the doll, showing the internal electromechanical mechanism.
Figure 2:
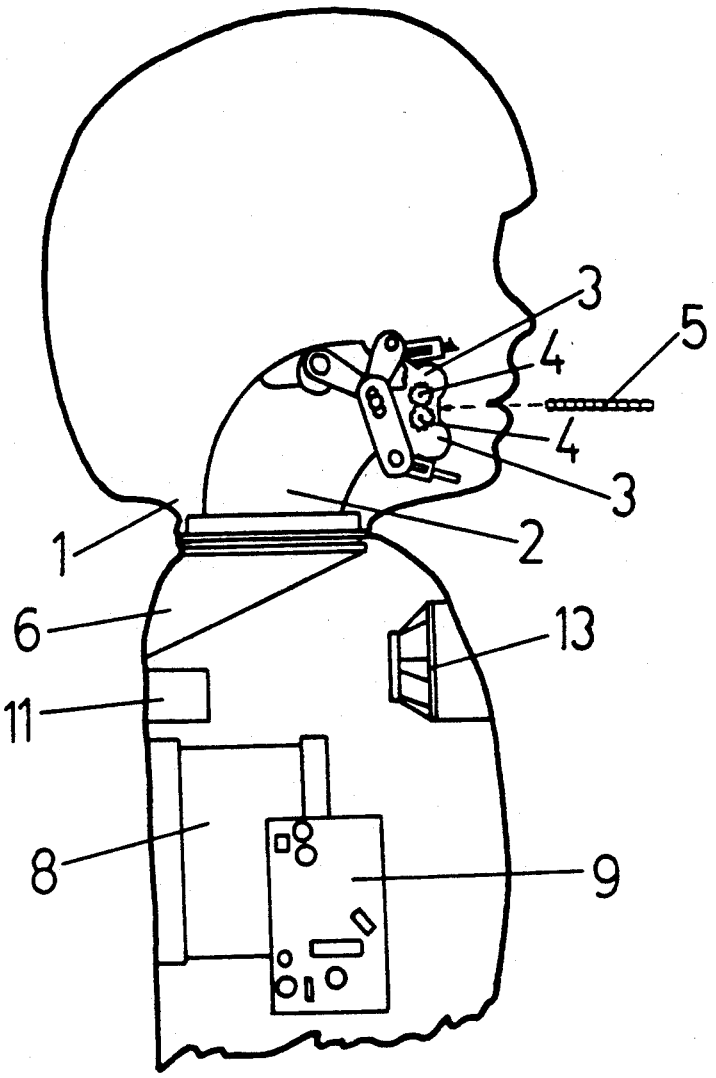
FIG. 2 is the side view of the doll shown in the FIG. 1 with the internal mechanism visible from the side.
Figure 3:
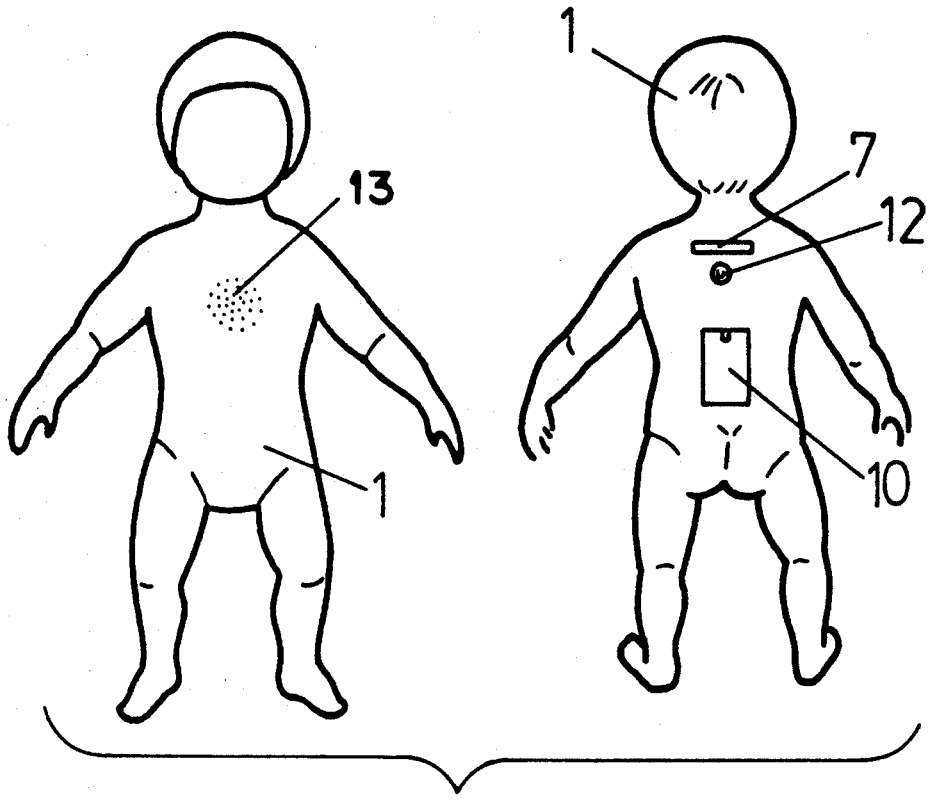
FIG. 3 is a double overall view, from the front and back of the doll shown in the foregoing figures.
Figure 4:
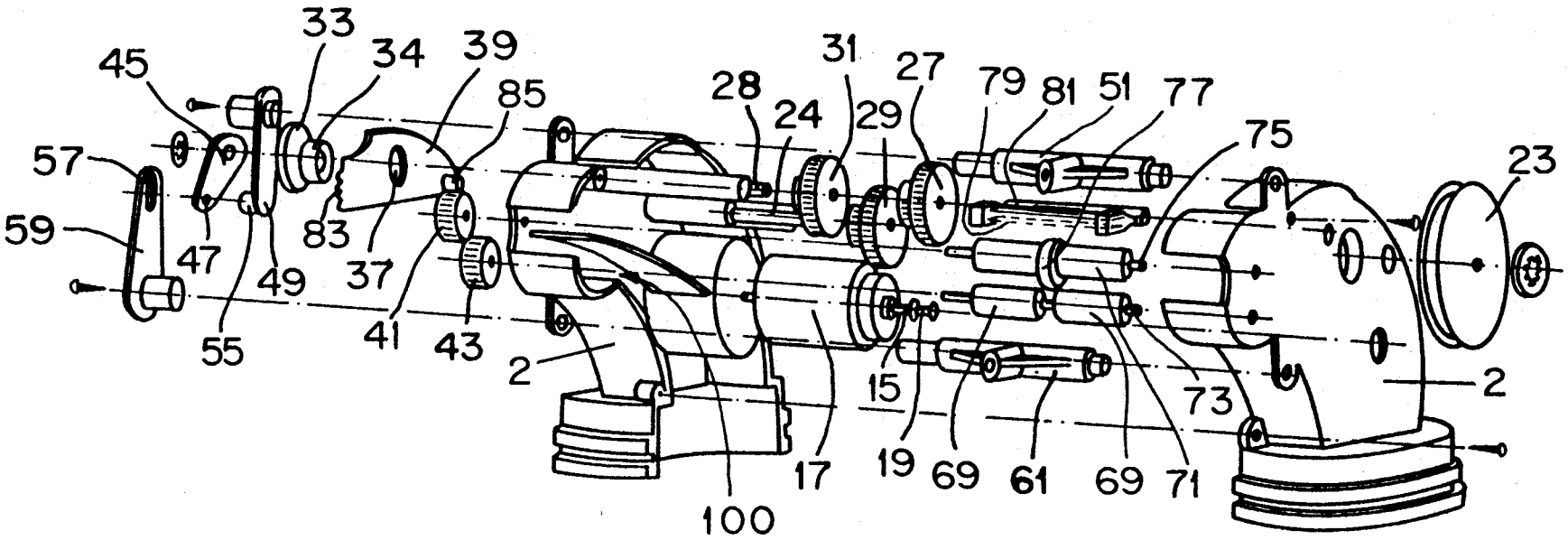
FIG. 4 is an exploded perspective of the mechanism for entrainment of the cookie slab.

Referring to the drawings, the doll 1 of the invention assumes outwardly a desired conventional form, and it contains in its interior a mechanism, lodged in a housing 2 and formed on the basis of a combination of parts and wheels, with its corresponding drive pinions functionally coupled together, for the intermittent displacement of a cookie 5 introduced in the doll's mouth.

The housing 2 extends below to a box 6 closed at its base, into which the cookie falls by gravity after it has been swallowed by the doll, so that it is deposited therein until it is extracted, which is achieved through the outer opening 7 provided on the back of the doll and covered externally by a flap cover.

Inside the doll is lodged also a second closed housing 8 which contains a set of batteries which in turn are connected to the electronic circuit 9 which they control and through which the various mechanisms are actuated. Access to the interior of the housing is obtained by means of an opening, located on the back of the doll, which is closed on the outside by the cover 10, adjustable thereon.

The electronic circuit is connected to an on-off switch 11, which is operated by means of the push button 12 also situated on the doll's back.

Forming part of the assembly of elements included in the doll's body is an acoustic device 13, controlled by the electronic circuit 9 to which it is connected. By this device different phrases are emitted, the content of which varies in coordination with the displacement stages of the cookie 5 and its final fall into the box 6. Hearing of these phrases is facilitated in that the doll has been provided, in the zone of the chest behind which said device is coupled, with a succession of holes 14 which permit the projection of the sounds in due intensity and clarity.

The doll having been organized in this manner and the internal mechanism set in operation by pressing the switch 12 situated on the back of the user, the first emission of sound in the form of a phrase takes place. After the cookie slab 5 has then been placed in the doll's mouth, the assembly of parts and wheels takes it along at intervals toward the interior and coordinated with these intervals the phrase pronounced changes. Having been introduced all the way, the cookie falls to the bottom of the box 6 where it stays until it is extracted manually, these successive stages representing a new change of sounds.

More particularly, and as best shown in FIGS. 1–2 and 4–7, the shaft 15 of motor 17 is provided with a drive pulley 19 suitably affixed to the shaft 15. This drive pulley 19 via belt 21 drives/rotates a large pulley wheel 23 (about shaft 24) which has affixed thereto pinion wheel 25. The pinion wheel 25 in turn drives/rotates a combination first gear/pinion 27 (about shaft 28), the pinion of which in turn drives a combination second gear/pinion 29 (about shaft 24). The pinion of this second integrally made gear/pinion combination in turn drives gear 31 affixed to shaft 28 which in turn rotates disc 33 (affixed to shaft 28) with its eccentric hub 34 and eccentric pin 35.

The hub 34 in turn engages an aperture 37 in sector gear 39 so as to provide an oscillating motion to the sector gear 39 which intermittently (once every revolution of the disc 33) drives upper cookie roller gear 41. This gear 41 in turn drives a lower cookie roller gear 43.

A link element 45 parallel to the sector gear 39 is driven by the eccentric pin 35 and this link element 45 is provided with an aperture 47 at its other end. A further link 49 is affixed to a pivotable socket hole element 51 for providing the upper lip 53 with movement simulating chewing (up and down like movement). This link 49 has a pin 55 passing through the aperture 47, and a slot 57 in a further link 59 which is affixed to another pivotable socket hole element 61 for providing the lower lip 63 with movement simulating chewing (up and down like movement).

The pivotable socket hole elements 51 and 61 are each provided with pins 65 and 67, loosely fitted in holes provided in the socket elements 51 and 61, respectively. The pins 67 and 65 in turn are fixedly connected to lower lip 63 and jaw area of the doll and to the nose area immediately above the upper lip 53. The pins 65 and 67 when moved by the pivoting action provide the doll's face with a realistic chewing movement of the mouth during the time the cookie 5 is being drawn between rollers 69 and 71 which are affixed to shafts 73 and 75, respectively; and such rollers 69 and 71 turn when the upper and lower cookie roller gears 41 and 43 are rotated.

The upper roller 71 is provided with a loosely fitting roller wheel 77 about shaft 75 for forcing the lower motor contact switch 79 to make electrical contact with the upper motor contact 81 so that the motor is started for commencing the chewing cycle of operation.

It should also be noted that the sector gear 39 is slidably mounted at the end opposite the gears 83 by means of a pin 85 guided in slot 87 in the housing 2.

The cookie 5 after it leaves rollers 69 and 71 drops down passageway or chute 100 immediately behind the rollers and is suitably retrieved from the chute 100 by opening a flap cover on the outer opening 7 provided on the back of the doll 1.

Various sounds, including words and phrases are emitted from speaker 13 by conventional IC electronic means (such as those used in automobiles, etc.) forming part of the doll's overall electronic circuit 9. For example, although not limited thereto, the doll may be provided with the following sounds and phrases:

A. Mamma Mamma, I am hungry.

B. Crunching or eating sounds to simulate chewing on hard cookies.

C. Yum, its delicious; Yum, its delicious.

D. Give me more, give me more.

These sounds and phrases are emitted in a predetermined pattern when the on-off switch 11 is activated to start the playing sequence. Once a cookie is introduced into the mouth of the doll between the cookie rollers 69 and 71, a few repeating crunching sounds are heard followed by, yum, its delicious a couple of times. Once the cookie 5 passes through the cookie rollers 69 and 71 and drops down the passageway or chute 100, a further phrase is heard "give me more, give me more" and "Mamma, Mamma, I am hungry" is repeated until the switch 11 is deactivated or until a further cookie is inserted between the cookie rollers 69 and 71 in which event the playing sequence is commenced again and repeated over in a like manner. Other words or phrases and/or sounds may be employed with the novel doll of the present invention, depending upon one's language or custom and tradition, but as all eating sounds alike, only the wording and/or phrases may be different from other languages and customs.

In operation, while the "cookie eating mechanism" functions the moment, the cookie 5 (which is nothing more than a plastic or hard flat object) is inserted into the mouth and between the cookie rollers 69 and 71, the cookie 5 is then intermittently advanced through the rollers 69 and 71 by means of the oscillation sector gear 39. However, no sounds or phrases are emitted unless the switch 11 is also activated or turned on at the same time by closing same.

Figure 5:
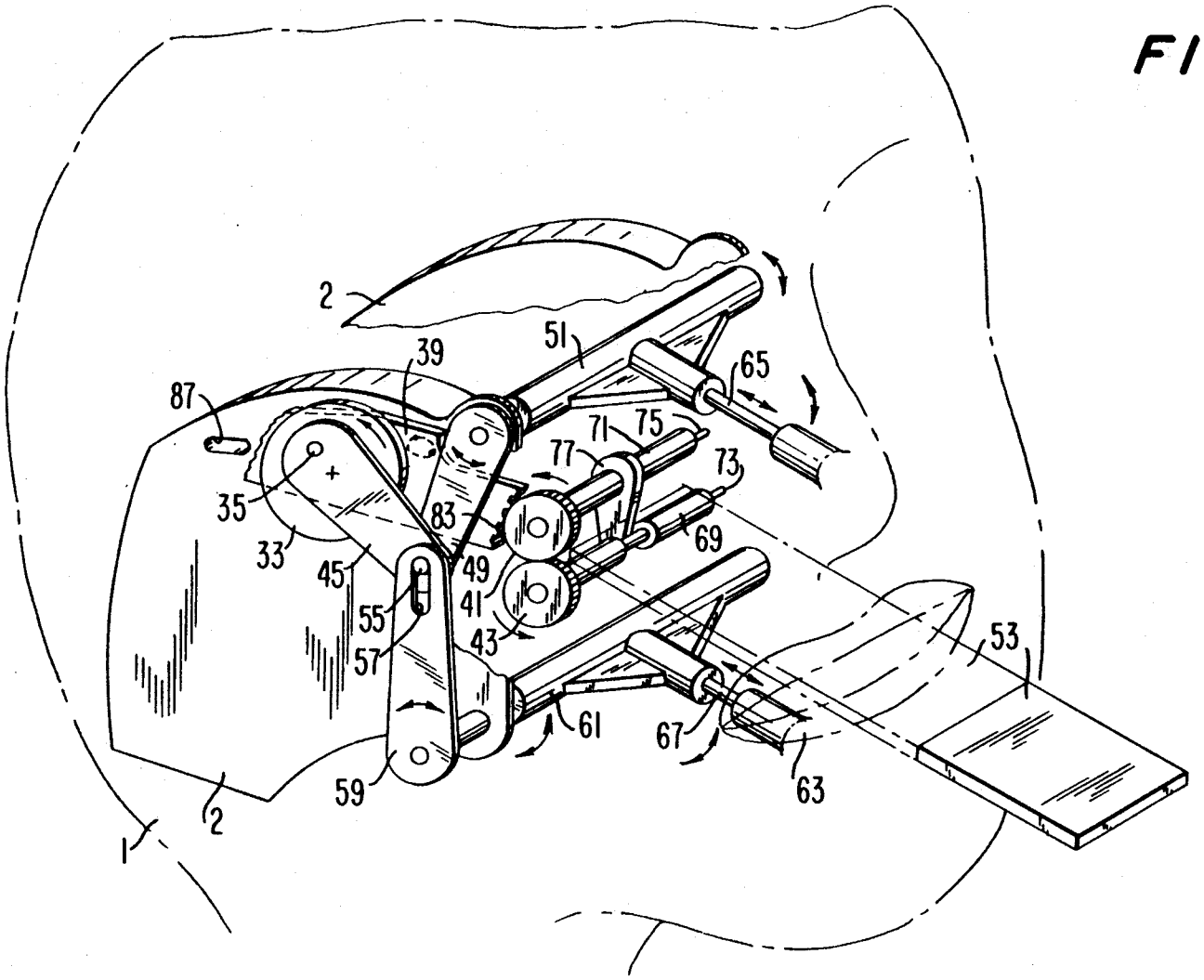
FIG. 5 is a further perspective view of portions of the mechanism of FIG. 4, but shown within the head or skull of the doll.
Figure 6:
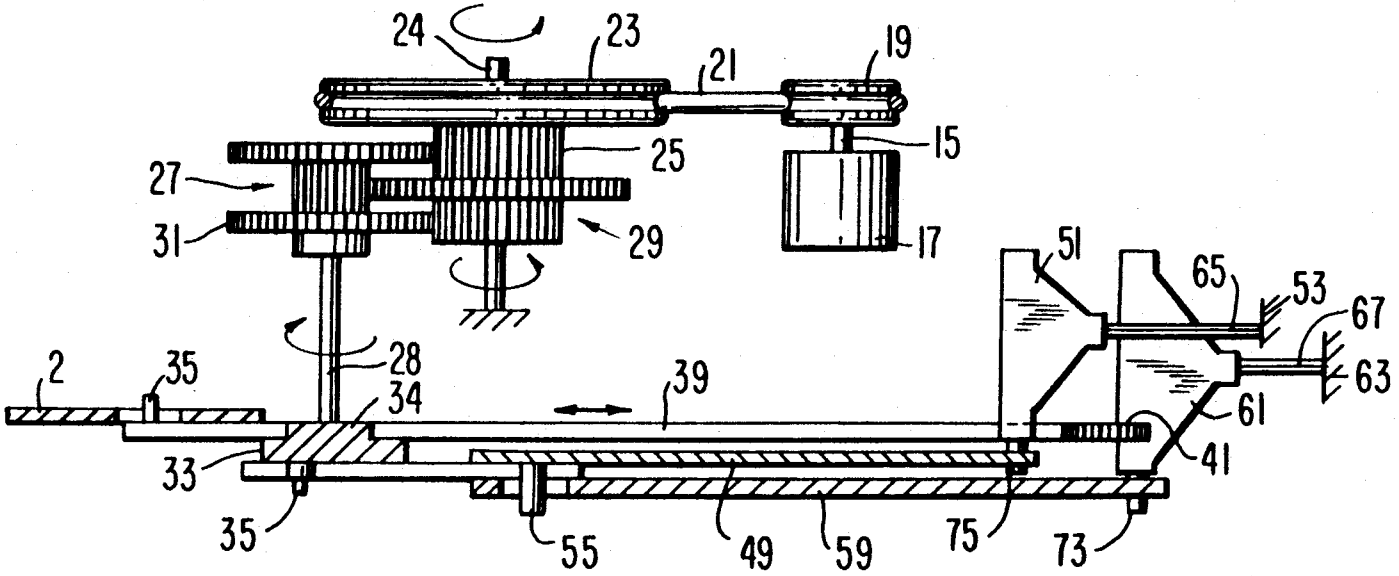
FIG. 6 is a diagrammatic, fragmentary plan view of some of the mechanical gearing relationships of the driving components of the mechanism.
Figure 7:
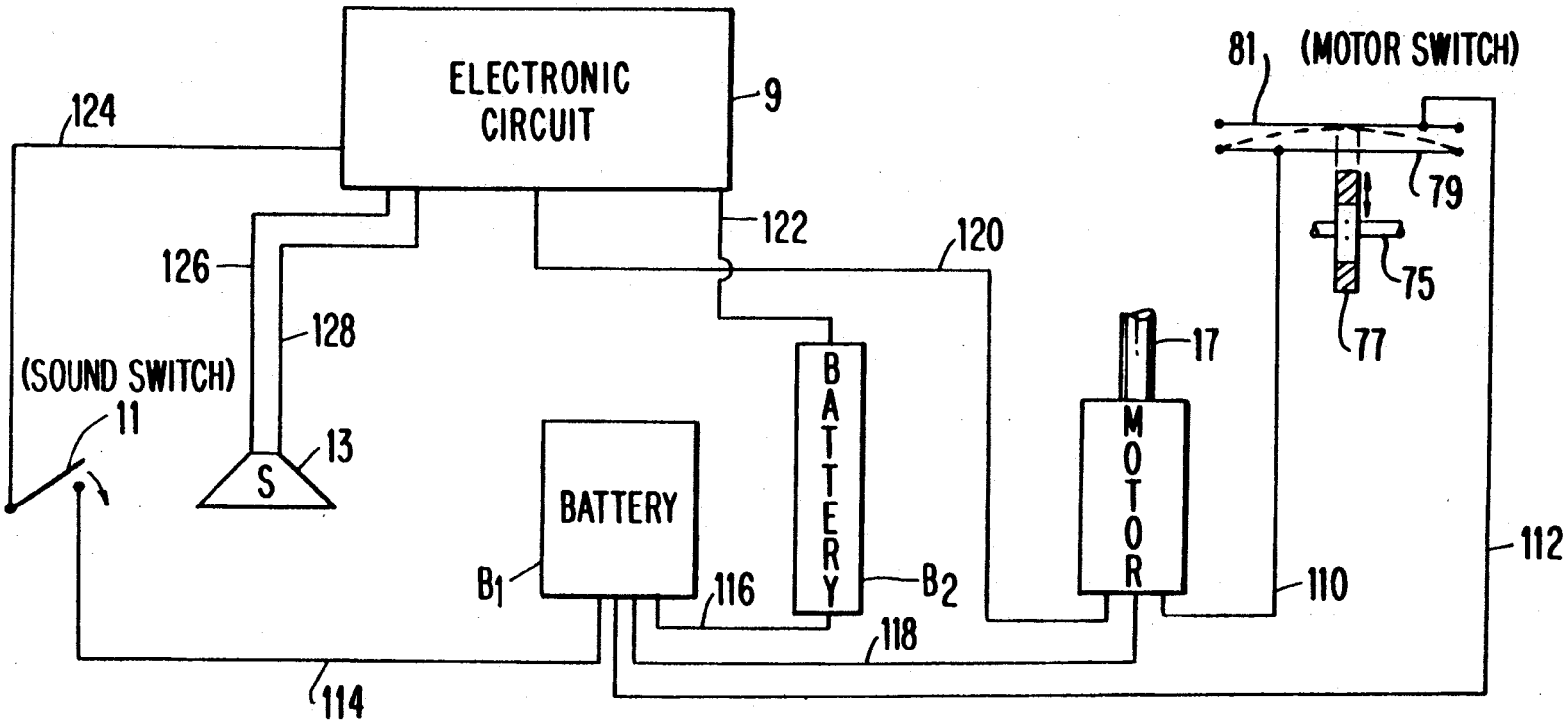
FIG. 7 is a diagrammatic electrical circuit showing the interconnections between the components of the electronic circuit for powering the doll's movable mechanisms and the acoustic device.

Arrowheads are shown in FIGS. 5–7 to indicate the movement of the various elements of the doll's mechanism. Some movements are rotational, oscillating, pivotal or back and forth (arc movement) and others are simply up and down, such as done by the loose roller wheel 77 which is pushed up by the cookie 5 and used to force the lower motor contact 79 to make contact with the upper motor contact 81, thereby completing the electrical circuit and causing the motor 17 to rotate, as is shown in the diagrammatic circuit drawing of FIG. 7 where the phantom lines of lower contact 79 are shown pushed up by the roller wheel 77. Although separate batteries are shown in FIG. 7, a single battery having sufficient power may be employed in the practice of the invention. However, two batteries are preferred as one directly powering the acoustic device or speaker 13 independent of powering the motor lends itself to longer life and greater flexibility in operating the doll as a play toy.

It should be understood that the component parts that make up the doll are preferably made of numerous materials known to those skilled in the art. For example, the doll's body or torso is of a rigid plastic material, whereas the doll's head is of a soft flexible plastic material due to the movable jaws and chewing action imparted to the jaws by the "cookie eating mechanism", and the head is suitably attached to the body at the neck area in a conventional manner. In a like manner, the limbs are suitably connected to the body.

The batteries B1, and B2 are electrically connected to the electromechanical components of the doll 1 by leads as shown in FIG. 7. Thus, lead 110 connects electrically the lower motor contact switch 79 to the motor 17 and lead 112 connects the upper motor contact switch 81 with battery (pack-4 batteries) B1, which in turn is connected by lead 114 to the sound switch 11 and by lead 116 to the battery B2 for powering the acoustic device 13. This battery B2 is suitably of 9 volts in size, whereas battery B1, are four AA sized batteries (1.5 volts) suitably connected in series in the battery case or housing 8 having two compartments (not shown), one for the single battery B2 and the other for battery B1 comprising the four batteries in series.

The motor 17 is also connected by an electrical lead 118 to battery B1; and the motor 17 and battery B2 are in turn connected by leads 120 and 122, respectively to the integrated electronic circuit 9. The sound switch 11 is connected by lead 124 to the integrated circuit 9 as is speaker 13 by means of electrical leads 126 and 128. Sound switch 11 is "opened" or "closed" by pressing switch 12 on the back of the doll 1 so that the doll can talk and make typical eating sounds; and motor switch 79–81 energizes the motor 17 when a cookie 5 is placed between the cookie rollers 69 and 71 so as to advance the cookie 5 into the mouth while generating an eating-like motion to the jaw and lips 53, 63 of the doll 1. As noted hereinabove, the cookie 5 is advanced through the cookie rollers 69 and 71 intermittently as the segment gear 39 engages gear 41 attached to the upper roller 71 once each revolution of the disc 33 so that the cookie 5 then drops free by gravity down the passageway or chute 100 to the storage area in the body of the doll 1 directly adjacent the door 7 used for removing a "consumed" cookie 5.

The cookies 5 may suitably be of rectangular shape or square or round, but they must all be of a predetermined thickness to fit between rollers 69 and 71 so as to pass therethrough while at the same time energize the motor 17 during such time. Of course, the cookies 5 should be of a width to fit along the length of the rollers 69 and 71 and be of a size to be easily inserted into the doll's mouth.

Although several embodiments of the invention have been illustrated and described herein, it will be understood that the invention is not limited to the embodiments disclosed, but is capable of many rearrangements, modifications and substitutions without departing from the scope of the invention.

I claim:

1. A toy doll having a head, limbs and body, and a mouth with upper and lower lips, comprising: a cookie "eating" mechanism, a storage area for cookies fed to the doll including a passageway leading from the mouth to said storage area; a pair of cookie rollers for advancing a cookie into the doll's mouth, and an electrically driven motor including a drive train for rotating the cookie rollers intermittently so that said cookie is drawn into the mouth in an intermittent step by step manner, rather than in a single continuous movement, and for discharging said cookie into said passageway, whereby said cookie is stored until retrieved for further use.

2. The toy doll according to claim 1, further including pivotable elements connected to said drive train and to the lips of said doll for simulating and generating an eating-like motion about the doll's mouth.

3. The toy doll according to claim 2, wherein said pivotable elements are connected to said lips by means of pins affixed to the lips and slidably fitted in apertures in said pivotable elements, whereby the pins move within said apertures as the pivotable elements are pivoted by said drive train.

4. The toy doll according to claim 3, wherein said pivotable elements are continuously pivoted by said drive train.

5. The toy doll according to claim 4, wherein said drive train includes a motor driven wheel having a pinion secured thereto, and a gear train for driving the cookie rollers intermittently and for pivoting the pivotable elements continuously.

6. The toy doll according to claim 5, wherein said gear train includes a set of gears powering a plurality of links, and an oscillating sector gear for intermittently rotating said cookie rollers.

7. The toy doll according to claim 6, wherein said gear train further including a rotatable disc having an eccentric pin and eccentric hub on opposite sides of said disc for oscillating said sector gear and for pivoting said pivotable elements continuously.

8. The toy doll according to claim 7, wherein said oscillating sector gear is provided with a pivot pin slideable in a fixed slot at an end opposite to said oscillating sector gear.

9. The toy doll according to claim 8, wherein said links are three in number, with two connected to said pivotable elements and to the third link which is further connected to said eccentric pin of said rotatable disc.

10. The toy doll according to claim 1, further including electronic means including an integrated circuit for generating sound, connected to said electrically driven motor for creating audible sounds and/or message phrases.

11. The toy doll according to claim 10, wherein said audible sounds and/or message phrases are transmitted when the cookie eating toy doll is fed a cookie.

12. The toy doll according to claim 11, wherein said audible sounds created during "eating" of said cookie include crunching and other eating noises, and a phrase "yum, its delicious".

13. The toy doll according to claim 12, further including other audible phrases emitted when said cookie has passed through said cookie rollers, including "give me more" and "mamma mamma, I am hungry".

14. The toy doll according to claim 13, wherein said motor and electronic means are battery powered, and said circuit for generating sound is operable only when a sound switch in the circuit is energized or closed by a user of said toy doll.

15. The toy doll according to claim 14, wherein said motor and drive train are housed in the head of said doll, and said electronic means and means for powering same and said motor are housed in said body of said doll.

16. The toy doll according to claim 15, wherein said means for powering comprise batteries.

17. The toy doll according to claim 1, wherein said electrically driven motor and drive train are energized by a motor switch in said head which is closed upon insertion of a cookie between said pair of cookie rollers.

18. The toy doll according to claim 17, wherein said motor switch comprises upper and lower contact elements connected to said motor via a battery, and energized or closed by means of a loosely fitted roller disposed about the upper cookie roller so as to be displaced in a manner to force the lower contact element of said motor switch into contact with said upper contact element.

19. The toy doll according to claim 1, wherein an access door is located on the back of said doll to enable the user to retrieve said cookie from said storage area.

20. The toy doll according to claim 18, wherein said battery includes a plurality of batteries, all of which are removably or replacably housed in the body of said doll.

* * * * *